US007471042B2

(12) United States Patent
Fujitani et al.

(10) Patent No.: US 7,471,042 B2
(45) Date of Patent: Dec. 30, 2008

(54) PLASMA DISPLAY PANEL WITH AN IMPROVED ELECTRODE

(75) Inventors: Morio Fujitani, Kadoma (JP); Hiroyuki Yonehara, Hirakata (JP); Masaki Aoki, Minoo (JP); Keisuke Sumida, Hirakata (JP); Hideki Asida, Suita (JP); Junichi Hibino, Neyagawa (JP); Daisuke Adachi, Kameoka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 10/466,951

(22) PCT Filed: Feb. 5, 2002

(86) PCT No.: PCT/JP02/00912

§ 371 (c)(1),
(2), (4) Date: Dec. 8, 2003

(87) PCT Pub. No.: WO02/063651

PCT Pub. Date: Aug. 15, 2002

(65) Prior Publication Data

US 2004/0080270 A1 Apr. 29, 2004

(30) Foreign Application Priority Data

Feb. 6, 2001 (JP) ..... 2001-029085

(51) Int. Cl.
*H01J 11/02* (2006.01)
*H01J 9/02* (2006.01)

(52) U.S. Cl. ..... 313/582; 313/583; 313/633

(58) Field of Classification Search ..... 313/582, 313/583, 633; 445/24
See application file for complete search history.

(56) References Cited

U.S. PATENT DOCUMENTS

| | | | | | |
|---|---|---|---|---|---|
| 3,803,708 | A | * | 4/1974 | Wada et al. | 29/620 |
| 4,541,876 | A | * | 9/1985 | Hwang | 148/22 |
| 4,996,171 | A | * | 2/1991 | Davey et al. | 501/19 |
| 5,003,279 | A | * | 3/1991 | Morinaga et al. | 336/192 |
| 5,183,594 | A | * | 2/1993 | Yoshinaka et al. | 252/519.33 |
| 5,339,068 | A | * | 8/1994 | Tsunoda et al. | 338/332 |
| 5,672,848 | A | * | 9/1997 | Komorita et al. | 174/260 |
| 5,851,732 | A | | 12/1998 | Kanda et al. | |
| 5,902,498 | A | * | 5/1999 | Mistry et al. | 219/121.64 |
| 6,040,056 | A | * | 3/2000 | Anzaki et al. | 428/432 |
| 6,075,319 | A | * | 6/2000 | Kanda et al. | 313/584 |
| 6,086,790 | A | * | 7/2000 | Hayashi et al. | 252/500 |
| 6,156,433 | A | * | 12/2000 | Hatori et al. | 428/411.1 |
| 6,156,454 | A | * | 12/2000 | Bernard et al. | 429/223 |

(Continued)

FOREIGN PATENT DOCUMENTS

CN 1220291 6/1999

(Continued)

*Primary Examiner*—Nimeshkumar D Patel
*Assistant Examiner*—Anthony T Perry

(57) ABSTRACT

An object of the present invention is to provide a technique for relatively easily suppressing the yellowing of a Plasma Display Panel in which electrodes comprising silver are disposed on the substrates, and thus render image displays with high luminance and high quality. In order to achieve the object, an arrangement is made in which the electrodes comprising silver further include an element whose standard electrode potential is lower than that of silver, such as Cr, Al, In, B, and Ti, or a compound of such an element, as a silver ionization inhibiting substance.

15 Claims, 7 Drawing Sheets

U.S. PATENT DOCUMENTS

| | | | | |
|---|---|---|---|---|
| 6,160,345 | A * | 12/2000 | Tanaka et al. | 313/489 |
| 6,333,600 | B1 * | 12/2001 | Mizobata | 313/587 |
| 6,337,028 | B1 * | 1/2002 | Masuko et al. | 216/4 |
| 6,368,378 | B2 * | 4/2002 | Sasaki | 75/252 |
| 6,444,281 | B1 * | 9/2002 | Wang et al. | 428/34 |
| 6,455,197 | B1 * | 9/2002 | Bernard et al. | 429/223 |
| 6,517,400 | B1 * | 2/2003 | Cho et al. | 445/24 |
| 6,808,654 | B2 | 10/2004 | Hayashi et al. | |
| 6,869,751 | B1 | 3/2005 | Asida et al. | |
| 2003/0030376 | A1 | 2/2003 | Aoki et al. | |
| 2005/0134177 | A1 | 6/2005 | Asida et al. | |

FOREIGN PATENT DOCUMENTS

| | | | |
|---|---|---|---|
| JP | 55107701 | A * | 8/1980 |
| JP | 01-274338 | | 11/1989 |
| JP | 09190766 | A * | 7/1997 |
| JP | 9-231909 | | 9/1997 |
| JP | 09231909 | A * | 9/1997 |
| JP | 10-255670 | | 9/1998 |
| JP | 10-302648 | | 11/1998 |
| JP | 11096918 | A | 4/1999 |
| JP | 11-174993 | | 7/1999 |
| JP | 11-242935 | | 9/1999 |
| JP | 11297210 | A * | 10/1999 |
| JP | 2000011892 | A | 1/2000 |
| JP | 2000169764 | A | 6/2000 |
| JP | P2000-231877 | A | 8/2000 |
| JP | 2000-260336 | | 9/2000 |
| JP | 2000332384 | A | 11/2000 |
| JP | 2001084833 | A * | 3/2001 |
| JP | 2001151532 | A | 6/2001 |
| JP | 2001-236880 | | 8/2001 |
| JP | 2001-236885 | | 8/2001 |
| WO | 99/61617 | | 12/1999 |
| WO | WO 01/46979 | | 6/2001 |

* cited by examiner

PLASMA DISPLAY PANEL WITH AN IMPROVED ELECTRODE

DESCRIPTION

1. Technical Field

The present invention relates to plasma display panels used as display devices, particularly to plasma display panels comprising silver electrodes.

2. Background Art

In recent years, Flat Panel Displays (FPDs) have been attracting attentions as display devices used in bi-directional information terminal devices and the like.

Different kinds of FPDs have been developed, such as Liquid Crystal Displays (LCDs), Plasma Display Panels (PDPs), Field Emission Displays (FEDs), Electro Luminescence Display (ELs), and some of these have already been put on the market.

Among these FPDs, PDPs have characteristics that the other devices do not have, such as being self-luminous, being capable of displaying fine images, and being suitable for large-scale screens, and thus expectations are rising for the use of PDPs as wall-mounted large-screen TV displays.

Generally speaking, in a PDP, light emitting cells of different colors are disposed in a matrix. As one example, the Japanese Unexamined Patent Application Publication No.9-35628 discloses an AC surface-discharge-type PDP. This PDP has a structure as follows: A front glass substrate and a rear glass substrate are arranged in parallel with barrier ribs interposed therebetween. On the front glass substrate, pairs of display electrodes (scanning electrodes and sustaining electrodes) are disposed in parallel. These electrodes are covered with a dielectric layer. On the rear glass substrate, address electrodes are disposed so as to oppose and intersect the scanning electrodes at right angles. Phosphor layers of respective colors (red, green, and blue) are formed in spaces divided by the barrier ribs between the front and rear substrates. A discharge gas is enclosed in the spaces. This is how the cells that emit red, green and blue light are formed. By a driving circuit applying voltage to each electrode, a discharge is generated, and ultraviolet rays are emitted. The phosphor layers are excited with these ultraviolet rays to emit light, resulting image displays.

In the PDP described above, glass plates manufactured with a sodium borosilicate-system glass material using the float method are typically used for the front glass substrate and the rear glass substrate. For the display electrodes and the address electrodes, silver electrodes that are relatively inexpensive are often used, although Cr—Cu—Cr (chromium-copper-chromium) electrodes are also used sometimes.

In general, the silver electrodes are formed using the thick-film forming method. To be more specific, a silver paste made of silver particles, a glass frit, a resin, a solvent, and the like is applied as a pattern using the screen-printing method. Alternatively, a film made of silver particles, a glass frit, a resin, and the like is applied using the lamination method and is patterned. In either case, the applied paste or the applied film is baked at the temperature of 500 degrees centigrade or higher in order to fuse the silver particles together for improving conductivity as well as to remove the resin.

The dielectric layer is usually formed by (i) applying a paste made of powdered lead glass with a low melting point or the like and a resin, using the screen-printing method, the die coat method, the lamination method, or the like, and (ii) heating and baking the applied paste at a temperature of 500 degrees centigrade or higher.

The PDPs comprising such silver electrodes as described above are known to have a problem that the glass substrates and the dielectric layer tend to turn yellow around the silver electrodes. This yellowing in the glass substrates and the dielectric layer causes deterioration of luminance of blue cells, or a decrease in the color temperature at times of displaying full-white images, and may result in deterioration of image quality of the PDPs. Thus, there are demands for PDPs in which the glass substrates and the dielectric layer are less likely to turn yellow.

DISCLOSURE OF THE INVENTION

It is an object of the present invention to provide a technique to relatively easily inhibit yellowing of the panel in a PDP in which silver electrodes are disposed on the substrates, and thus actualize a PDP that is capable of display images with high luminance and high quality.

In order to achieve the object, the present invention provides a PDP in which silver electrodes are disposed on the substrates, wherein the silver electrodes further comprise an element or a compound whose standard electrode potential is lower than that of silver. Alternatively, the PDP may have an arrangement wherein the silver electrodes further comprise an element or a compound thereof, the element having a higher ionization tendency than silver.

As to "the standard electrode potential", the Encyclopedic Dictionary of Chemistry (published by Tokyo Kagaku Dozin) reads that "an equilibrium electrode potential at such a time when all the substances engaged in the electrode reaction of a simple electrode are in the standard state is referred to as the standard electrode potential".

Here, since the standard electrode potential of silver ($Ag^{+}+e^{-}=Ag$) is 0.8V, "an element or a compound whose standard electrode potential is lower than that of silver" has the same meaning as "an element or a compound whose standard electrode potential is lower than 0.8V".

As mentioned above, in a PDP of the prior art including silver electrodes, it is considered that the cause of yellowing around the silver electrodes is that, when the silver electrodes and the dielectric layer are baked, the silver included in the silver electrodes diffuses to the surroundings in the forms of ions, and the ions are then reduced at the glass substrates and inside the dielectric layer so as to form Ag colloids.

On the contrary, in the present invention, the silver electrodes include an element or a compound whose standard electrode potential is lower than that of silver, or an element or a compound thereof, the element having higher ionization tendency than silver; therefore such an element or such a compound serves to inhibit ionization of the silver, and thus, it is possible to inhibit generation and diffusion of silver ions at times of baking. As a result, generation of silver colloidal particles around the silver electrodes is also inhibited, and thus yellowing of the panel can be prevented.

In the present description, a substance that serves to inhibit ionization of silver such as "an element or a compound whose standard electrode potential is lower than that of silver" will be referred to as "a silver ionization inhibiting substance".

Here, it is the most appropriate for achievement of the object of the invention when "a silver ionization inhibiting substance" is "an element or a compound thereof that forms an oxide having a stronger chemical bond than silver". Accordingly, "silver ionization inhibiting substances" include "an element or a compound thereof that forms an oxide having a stronger chemical bond than silver."

Also, examples of substances that are preferable as silver ionization inhibiting substances include elements such as Cr, Al, In, B, Ti, as well as Ni, Pb, Zr, Sn, Zn and Co, and compounds of each of these elements. It has been also learned that it is preferable that the silver electrodes include the element or the compound of at least 1 wt % of the silver.

Additionally, as to a PDP in which silver electrodes are disposed on the substrates, it is also possible to achieve the aforementioned object when "a silver ionization inhibiting substance" exists as a layer that covers the silver electrodes, because the substance serves to inhibit ionization of silver likewise.

In order to achieve the aforementioned object, the present invention also provides a manufacturing method of a PDP in which silver electrodes are disposed on the substrates, wherein the electrode material that is used for forming the silver electrodes includes a silver ionization inhibiting substance mentioned above. Alternatively, an arrangement can be made so that, after the silver electrodes are formed, a coating layer is formed with a silver ionization inhibiting substance, so as to cover the silver electrodes.

Examples of methods of forming a coating layer with a silver ionization inhibiting substance include the vacuum evaporation method, the sputtering method, the plating method, the CVD method, and the sol-gel method.

Further, it is possible to achieve the aforementioned object by having an arrangement wherein the silver-electrode-purpose paste used for forming the electrodes of the PDP includes a silver ionization inhibiting substance that is mentioned above.

Furthermore, in order to achieve the aforementioned object, the present invention provides a transfer film to be used for forming electrodes of a plasma display panel, the transfer film including a silver electrode film material layer that is disposed on a supporting film, wherein the silver electrode film material layer includes a silver ionization inhibiting substance mentioned above.

BEST MODE FOR CARRYING OUT THE INVENTION

FIRST EMBODIMENT

General Structure of the PDP

Figure 1:
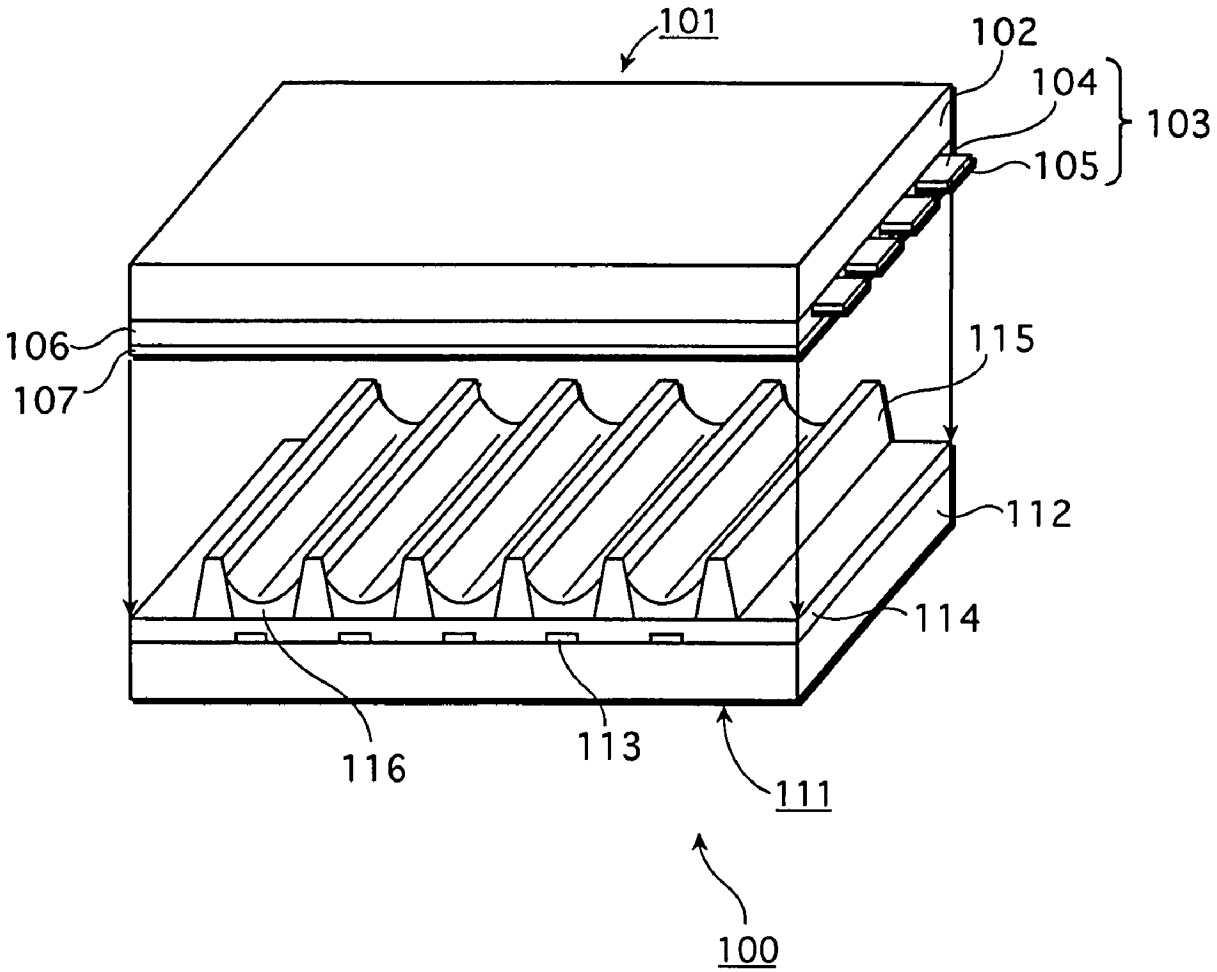
FIG. 1 is a perspective assembly drawing showing the structure of an AC surface-discharge type PDP in the embodiments.

FIG. 1 is a perspective assembly drawing showing the structure of an AC surface-discharge type PDP 100 in the embodiments.

In the PDP 100, a front panel 101 as a first substrate and a rear panel 111 as a second substrate are pasted together with a perimeter sealing member (not shown in the drawing).

In the front panel 101, display electrodes 103 are disposed in stripes on a front glass substrate 102; and a dielectric glass layer 106 and a protective layer 107 made up of Magnesium Oxide (MgO) cover the display electrodes 103 from the top.

The rear panel 111 is made up of a rear glass substrate 112 on which address electrodes 113, a dielectric glass layer 114, barrier ribs 115, and phosphor layers 116 (in colors of red, green, and blue are arranged in order) are provided.

In the PDP 100, the space between the front glass substrate 102 and the rear glass substrate 112 is divided into sections by barrier ribs 115 and a discharge gas is enclosed therein. The display electrodes 103 are provided extending perpendicular to the barrier ribs 115. The address electrodes 113 are provided extending in parallel to the barrier ribs 115. At intersections where the display electrodes 103 and the address electrodes 113 oppose each other, cells that emit light in colors of red, green, and blue are formed.

Although not shown in the drawing, the PDP display device is structured with a driving circuit that is connected to the display electrodes 103 and the address electrodes 113 in the PDP 100.

Structure of the Display Electrodes

Figure 2:
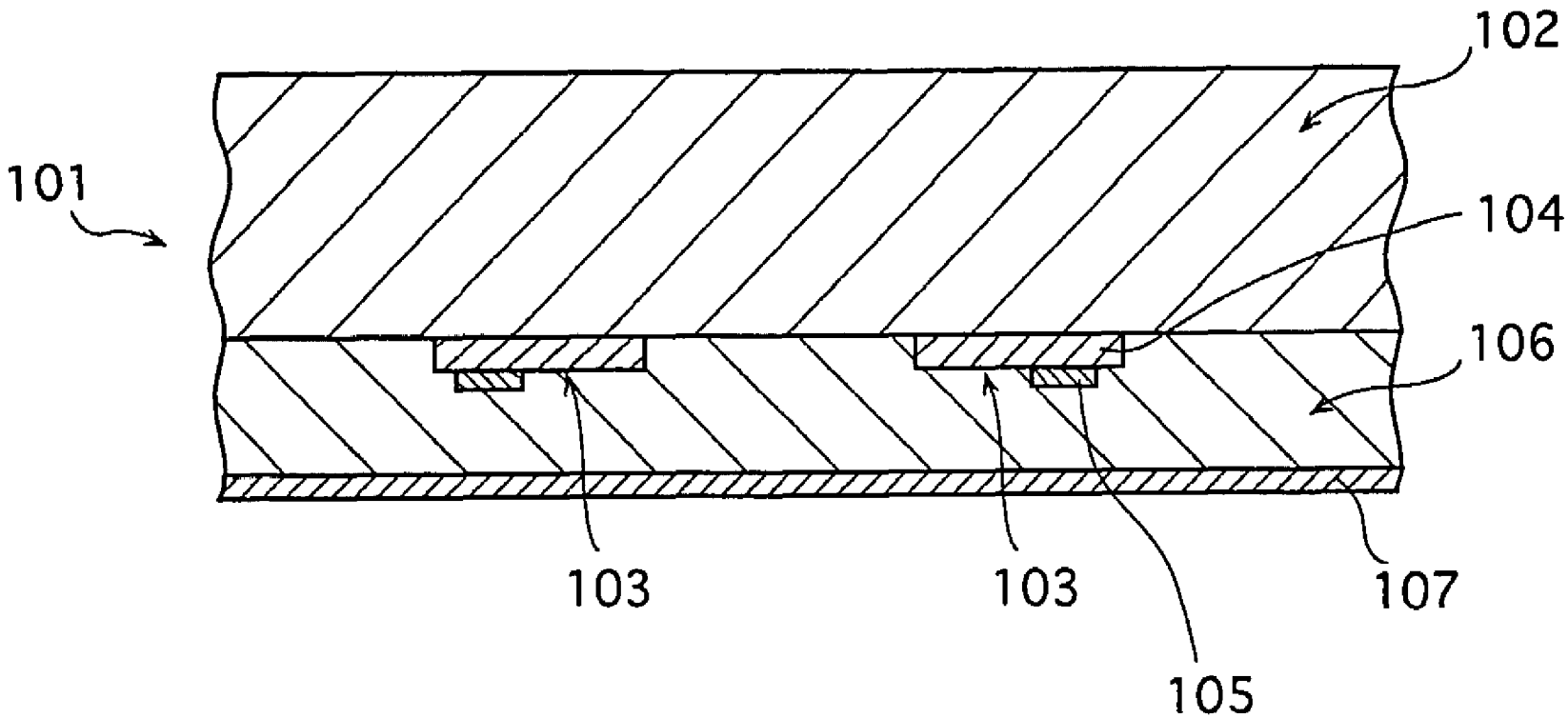
FIG. 2 is a cross section of the front panel of the first embodiment.

FIG. 2 is a cross section of the front panel 101.

As shown in the drawing, a display electrode 103 is made up of (i) a silver electrode 105 that is narrower and includes silver, being provided on top of (ii) a transparent electrode 104 that is wider and made of transparent material. Examples of materials of which the transparent electrode 104 may be made include electrically conductive metal oxides such as ITO, $SnO_2$, and ZnO.

In a display electrode 103, it is preferable to provide the silver electrode 105 on top of the transparent electrode 104 so as to maintain a large discharge area in a cell; however, it is also possible that a display electrode 103 is formed only with a silver electrode 105, without a transparent electrode 104.

The silver electrodes 105 are made by baking a silver paste or a silver film which is for electrode-purpose and includes a silver ionization inhibiting substance. To be more specific, the silver electrodes 105 include silver particles and a glass frit, just like a normal silver electrode, and further include a silver ionization inhibiting substance, in addition, that serves to inhibit silver ionization.

Silver Ionization Inhibiting Substances

Examples of silver ionization inhibiting substances include those described in one of the following groups ①, ②, and ③.

① An element or a compound whose standard electrode potential is lower than the standard electrode potential of silver (0.8V).

Examples of elements to be categorized in this group ① include: alkali metals (Li, Na, K, etc.); alkali-earth metals (Ca, Sr, Ba); Sc, Ti, V, Cr, Mn, Fe, Co, Ni, and Cu, which are transition metals (except for mercury) from which precious metals are excluded. The limitation of excluding precious metals from transition metals is made because the standard electrode potential of a precious metal is generally higher than 0.8V.

Examples of compounds to be categorized in this group ① include an oxide, a hydroxide, a halide, a nitride, a carbide, a nitrate, a carbonate, and a sulfate of each of the elements above.

Of those elements and compounds mentioned here, the following substances are preferred as silver ionization inhibiting substances:

Preferred elements are Ni, Pb, Zr, Sn, Zn, and Co, in addition to the elements described in the embodiments that will be mentioned later such as Cr, Al, In, B, and Ti.

Preferred compounds are oxides of the aforementioned elements Cr, Al, In, B, Ti, Ni, Pb, Zr, Sn, Zn, and Co, i.e. $ZrO_2$, $SiO_2$, $TiO_2$, $Al_2O_3$, $B_2O_3$, $P_2O_3$, $In_2O_3$ and so on. (Each of these oxides has a stronger chemical bond than an oxide of silver.) Hydroxides and halides of the aforementioned elements Cr, Al, In, B, Ti, Ni, Pb, Zr, Sn, Zn, and Co are also preferable compounds.

Nitrides such as TiN, ZnN, AlN, CrN, and BN as well as carbides such as TiC, SiC, and ZrC are also preferable compounds since each of them has a stronger chemical bond than an oxide of silver.

Among those compounds in group ①, the substances that are one of a nitrate, a carbonate, a sulfate, a hydroxide, and a halide are preferable because the valence of the metal element is maintained at the optimal level for inhibiting silver ionization at the time of baking electrodes.

From this point of view, compounds such as $Al(NO_3)_3$, $Ca(NO_3)_2$, $Zr(NO_3)_4$, $Ni(NO_3)_2$, $Co(NO_3)_2$, $Pb(NO_3)_2$, $BaCO_3$, $NiCO_3$, $MgCO_3$, $ZnCo_3$, $CoCO_3$ and $Cu_2CO_3$ are also preferable.

Figure 3:
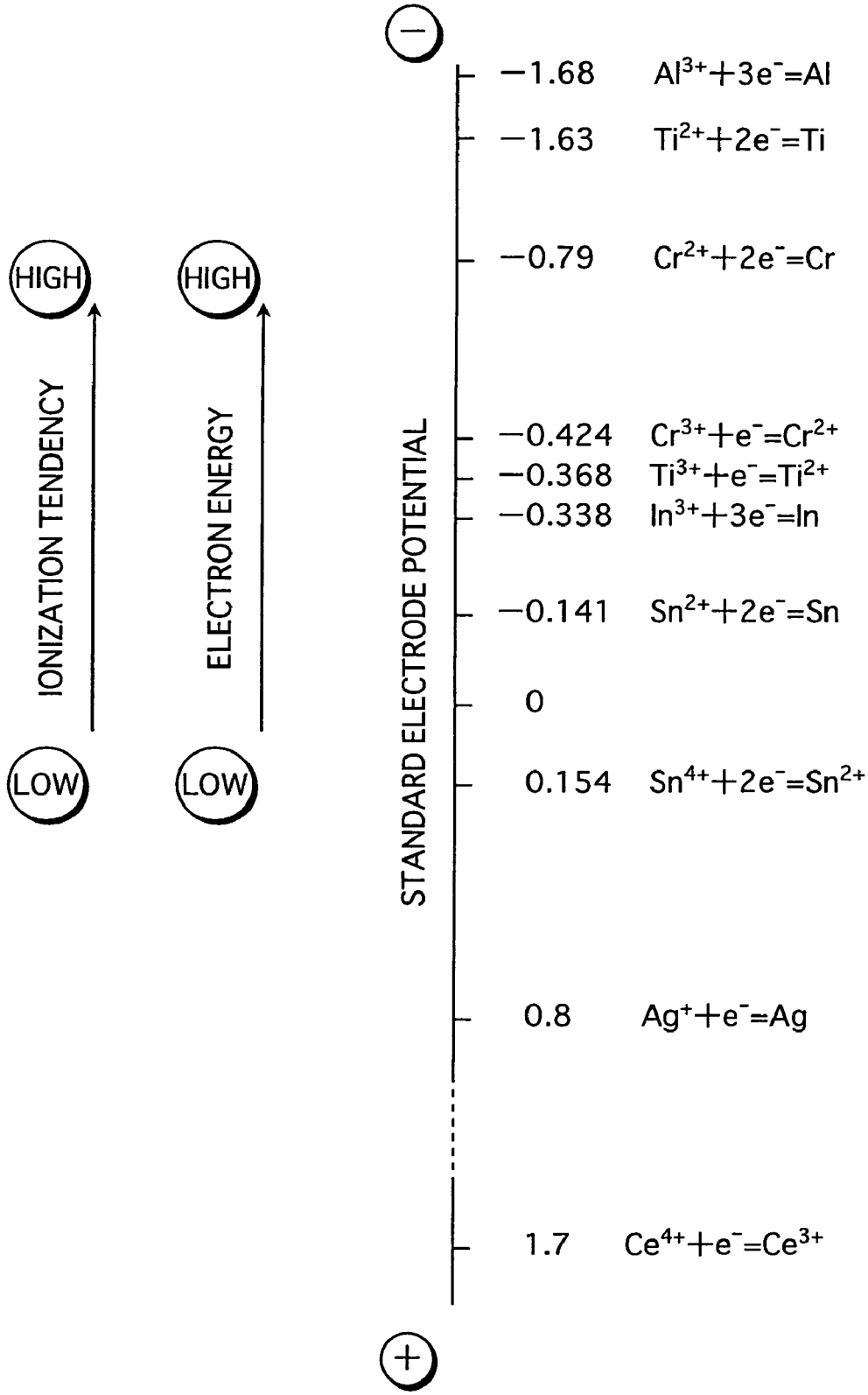
FIG. 3 is a chart illustrating the relation among ionization tendency, electron energy, and standard electrode potential.

FIG. 3 is a chart illustrating the relation among ionization tendency, electron energy, and standard electrode potential. The drawing shows the standard electrode potentials of some elements and ions.

As shown in the drawing, generally speaking, the lower the standard electrode potential of an element or an element ion (compound) is, the larger the electron energy is, and the more easily the electrons are released. Accordingly, when an element or a compound whose standard electrode potential is lower than 0.8 V (i.e. the standard electrode potential of silver) exists in the silver electrodes, it is possible to inhibit ionization of the silver.

Among elements and compounds whose standard electrode potentials are lower than 0.8V, the lower the standard electrode potential is (the elements or compounds corresponding to the ions that are positioned in the upper side of the chart in FIG. 3), the larger the inhibitive influence on silver ionization is, and the larger the inhibitive influence on yellowing of the panel at the time of baking is.

Additionally, as shown in FIG. 3, ions of an element have different standard electrode potentials depending on its valence. More specifically, it should be noted that, even if elements included in different compounds are the same kind, the standard electrode potentials of the compounds may vary depending on the valence of each of the elements included; therefore, a compound whose standard electrode potential is lower than silver, that is included in the silver electrodes 105, should be used as a silver ionization inhibiting substance.

② An element whose ionization tendency is higher than silver or a compound of such an element As shown in FIG. 3, generally speaking, a relation can be found that the lower the standard electrode potential of an element is, or an element ion (an element compound) is, the higher the ionization tendency is.

Accordingly, "An element or a compound whose standard electrode potential is lower than the standard electrode potential of silver (0.8V)" described in ① above substantially matches "An element whose ionization tendency is higher than silver or a compound of such an element".

③ An element that has higher ionization tendency than silver and forms an oxide having a stronger chemical bond than silver, or a compound of such an element Examples that fall into this group are Chromium (Cr) as an element, and Chromium Oxide ($Cr_2O_3$) as a compound.

In addition, examples of preferable elements include Si, Al, and Ti, and examples of preferable compounds include $SiO_2$, $Al_2O_3$, and $TiO_2$.

Normally, when silver electrodes are exposed to the atmosphere, the silver particles in the silver electrodes get oxidized by the oxygen in the atmosphere into silver oxide, or get sulfurized by $SO_2$ in the atmosphere into silver sulfide. Also, when an oxide having a weaker chemical bond than an oxide of silver exists near the silver particles, the silver particles are easily exposed to the atmosphere, and tend to be turned into silver oxide. When turned into silver oxide, it tends to diffuse to the surroundings as silver ions.

On the other hand, when the silver electrodes include an element that forms an oxide having a stronger chemical bond than silver, or a compound of such an element, the element or the compound serves as a blockage to prevent the silver particles from being exposed to the atmosphere.

In addition, since the oxide of such an element has a stronger chemical bond than an oxide of silver, silver will not be turned into silver oxide by the oxide of such an element.

Accordingly, when the silver ionization inhibiting substance included in the silver electrodes is an element that forms an oxide having a stronger chemical bond than silver, or a compound of such an element, the silver included in the silver electrodes is even less likely to be ionized.

As so far explained, when the silver electrodes 105 include a silver ionization inhibiting substance that falls into one of the groups ①, ②, and ③, it is possible to inhibit ionization of silver at the time of baking.

As additional information, as for elements or compounds described above as silver ionization inhibiting substances, it is acceptable that only one kind of such an element or a compound is used; however, needless to say, it is also acceptable to use two or more kinds of them together after combining them or otherwise. Also, an alloy that includes two or more kinds of metal elements mentioned above is also considered as a silver ionization inhibiting substance.

Amount of Silver Ionization Inhibiting Substance to be Added

As for the ratio of a silver ionization inhibiting substance described in ①, ②, and ③ to be included in the silver electrodes, it is preferable to arrange it to be 0.1 wt % or larger of the silver in order to achieve effects of inhibiting the yellowing of the panel, and it is preferable to arrange it to be 0.5 wt % or larger of the silver in order to achieve sufficient effects. It is preferable to arrange it to be 1 wt % or larger of the silver in order to achieve more advantageous effects.

On the other hand, it is preferable to arrange the ratio of the element or the compound mentioned above to be 20 wt % or smaller of the silver in order to ensure the conductivity of the silver electrodes, and it is further preferable to arrange it to be 10 wt % or smaller.

State of Existence of the Silver Ionization Inhibiting Substance in Silver Electrodes It is considered that it is basically possible to inhibit silver ionization no matter what state of existence the silver ionization inhibiting substance is in when it is included in the silver electrodes. In the silver electrodes 105 of the present embodiment, the silver ionization inhibiting substance exists in such a state that it covers the silver particles, as will be explained later, and the effects of inhibiting silver ionization are therefore considered to be large.

Figure 4:
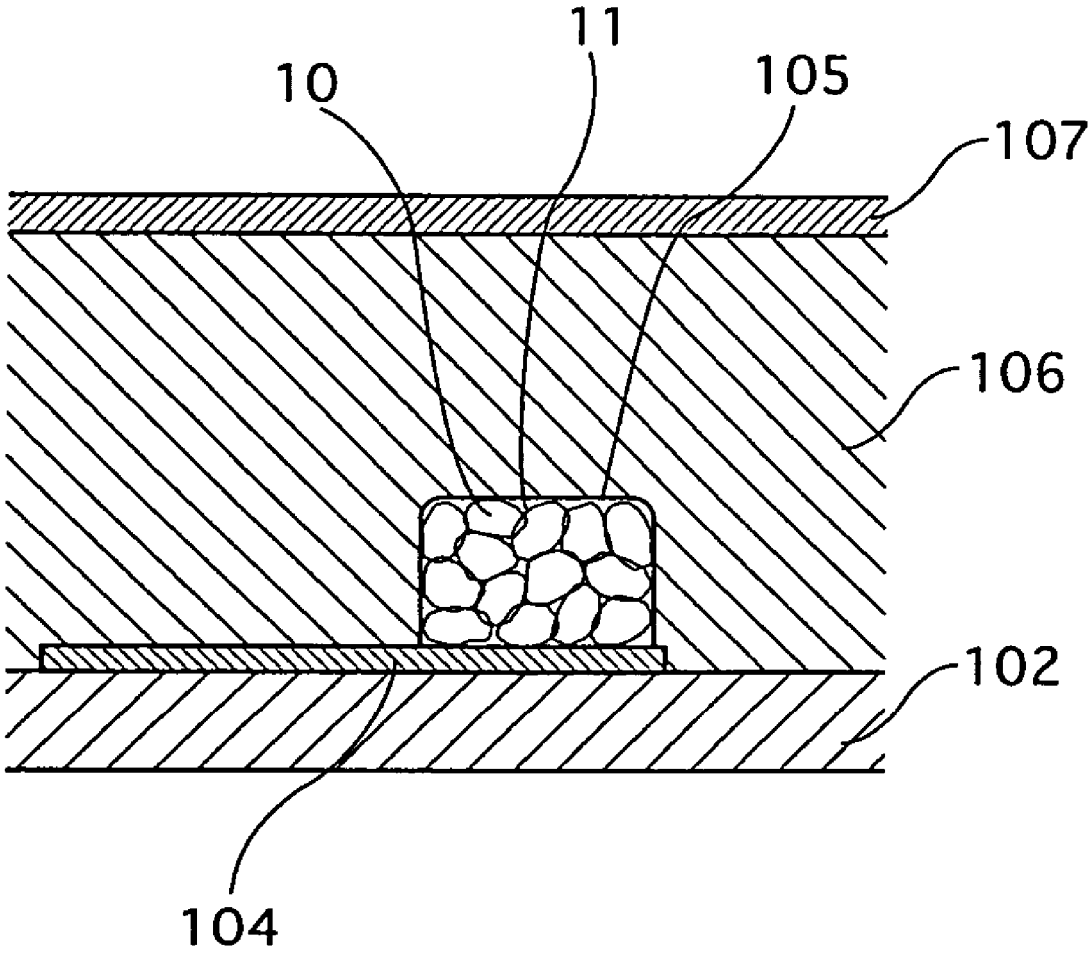
FIG. 4 is a schematic cross section of the front panel.

FIG. 4 is a schematic cross section of the front panel 101 mentioned above, especially to schematically illustrate the internal structure of the silver electrodes 105.

As shown in FIG. 4, in the silver electrodes 105, a plurality of silver particles 10 are bonded (in other words, silver particles 10 have fused with one another so as to form a conductive member); however, there are some spaces 11 between the silver particles 10. In these spaces 11, the glass frit and the silver ionization substance exist.

Accordingly, the silver ionization inhibiting substance exists in the vicinity of the surfaces of the silver particles 10 inside those spaces 11.

It is generally considered that silver is likely to be ionized, for example oxidized into silver oxide by the oxygen in the atmosphere, or sulfurized into silver sulfide by the $SO_2$ in the atmosphere, at the vicinity of the surfaces of the silver particles in the electrodes, while the silver electrodes are left in the atmosphere or while their temperature gets cooler after the baking.

Consequently, when the silver ionization inhibiting substance in the spaces 11 exists in the vicinity of the surfaces of the silver particles, the silver ionization inhibiting substance is located at the right position where the silver tends to be in contact with the atmosphere and silver ions are more likely to be generated; we are therefore able have stronger effects of inhibiting silver ionization, while the silver electrodes are left in the atmosphere or while their temperature gets cooler after the baking.

Normally, the diameter of a silver particle is approximately 1 μm to 3 μm. In view of this, it is preferable if the diameter of each of the particles in the silver ionization inhibiting substance to be used is 1 μm or smaller, so that it is easier for the silver ionization inhibiting substance to go into the spaces 11.

Additionally, it is possible to have the effects of inhibiting silver ionization as long as the silver ionization inhibiting substance is included in the vicinity of the surfaces of at least a part of the silver particles, not only when the silver ionization inhibiting substance exists in the vicinity of the surfaces of all the silver particles 10 inside the spaces 11; however, the effects of inhibiting silver ionization is strongest when it is arranged so that the silver ionization inhibiting substance exists in such a form that it covers the silver particles, and the silver ionization inhibiting substance exists on the surfaces of all the silver particles.

Manufacturing Method of the Front Panel

The following explains the method of manufacturing the front panel 101, particularly, the process of forming the silver electrodes 105 and the dielectric glass layer 106.

A glass plate manufactured using the float method is used as the front glass substrate 102. Transparent electrodes 104 are formed on the front glass substrate 102 using the normal thin-film forming method. Subsequently, after the silver electrodes 105 and the dielectric layer 106 are formed, the protective layer 107 is formed using the normal thin-film forming method. This is how the front panel 101 is manufactured.

The following describes in detail how to form the silver electrodes 105 and the dielectric glass layer 106.

Step 1: Forming a Silver Electrode Precursor Layer

A silver electrode precursor layer which is a precursor of the silver electrodes 105 will be formed on the transparent electrodes 104, with either a silver paste or a silver electrode transfer film.

In a case where a silver paste is used, a silver-electrode-purpose paste should be prepared. The paste includes, like the one used to form silver electrodes in general, silver powder, an organic binder, a glass frit (of $PbO—B_2O_3—SiO_2$-system, $ZnO—B_2O_3—SiO_2$-system, $PbO—B_2O_3—SiO_2—Al_2O_3$-system, $PbO—ZnO—B_2O_3—SiO_2$-system, $Bi_2O_3—B_2O_3—SiO_2$-system etc.), an organic solvent, and the like.

It should be noted that when this silver-electrode-purpose paste is prepared, the aforementioned silver ionization inhibiting substance gets mixed in.

As for the amount of the silver ionization inhibiting substance to be mixed into the silver-electrode-purpose paste, as mentioned above, it is preferable to arrange it to be 0.1 wt % or larger of the silver powder, and it is preferable to arrange it to be 0.5 wt % or larger of the silver powder in order to achieve sufficient effects. It is preferable to arrange it to be 1 wt % or larger of the silver powder in order to achieve more advantageous effects. It is also preferable to arrange it to be 20 wt % or smaller of the silver powder, and further preferable to arrange it to be 10 wt % or smaller.

As for the organic binder to be used in the silver-electrode-purpose paste, a cellulose compound such as ethyl cellulose or an acrylic polymer such as methyl methacrylate is preferable.

Then, it is acceptable to, using the screen-printing method, apply the paste in the pattern of the silver electrodes 105 and dry it. Alternatively, it is also acceptable to, using the screen-printing method or the die coat method, apply the paste to all over the substrate and dry it at first, and then pattern it using the photolithography method (or using the lift-off method).

On the other hand, in a case where a silver electrode transfer film is used, as will be explained later in detail, a silver electrode transfer film is prepared by processing the same components as in the silver paste mentioned above into a film, and the film will be laminated on the transparent electrodes 104 in order to form the silver electrode precursor layer.

In the silver electrode precursor layer formed like this, the glass frit, the organic binder, and the silver ionization inhibiting substance exist around the silver particles.

As for the silver ionization inhibiting substance to be mixed into the silver-electrode-purpose paste, when the diameter of each of the particle is 1 μm or smaller, it is possible to densely cover the surfaces of the silver particles with the silver ionization inhibiting substance, and therefore possible to enhance the effects of inhibiting silver ionization.

The following describes one of specific examples in which the silver electrode precursor layer is patterned using the photolithography method with use of a silver electrode transfer film, with reference to FIGS. 5A through 5D.

Figure 5A:
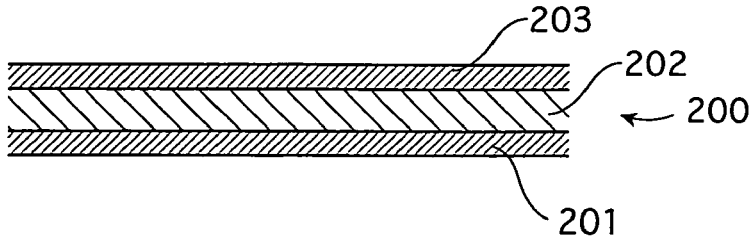
FIGS. 5A through 5D illustrate how to have a silver electrode precursor layer patterned with use of silver electrode transfer film.

FIG. 5A schematically illustrates the cross section of an electrode transfer film 200. In the electrode transfer film 200, a silver electrode precursor layer 202 and a cover film 203 are laminated on a supporting film 201. In order to prepare the electrode transfer film 200, a silver-electrode-purpose paste in which silver powder, an organic binder made of a photosensitive resin, a glass frit, a silver ionization inhibiting substance, and an organic solvent are mixed together is applied to all over the supporting film 201 made of PET and dried, using a blade coater, so as to form the silver electrode precursor layer 202. Then, it is covered with the cover film 203 to which a mold releasing process has been applied.

Figure 5B:
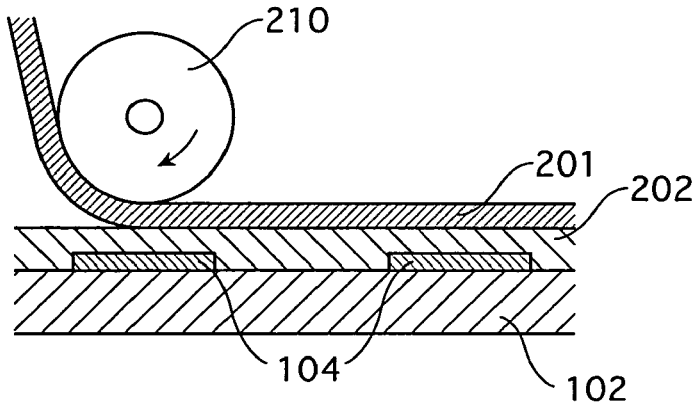

FIG. 5B shows how the silver electrode precursor layer 202 is laminated.

The cover film 203 gets removed from the electrode transfer film 200, and the silver electrode precursor layer 202 gets superposed onto the front glass substrate 102 on which the transparent electrodes 104 have been formed, and gets pressed by a heating roller 210 from over the supporting film 201. Thus, the silver electrode precursor layer 202 gets pressed with heat onto the front glass substrate 102. (The surface temperature of the heating roller 210 is 60 to 120 degrees centigrade, and the roller pressure is 1 to 5 kilograms/$cm^2$, for example.) This way, the silver electrode precursor layer 202 has been transferred.

Figure 5C:
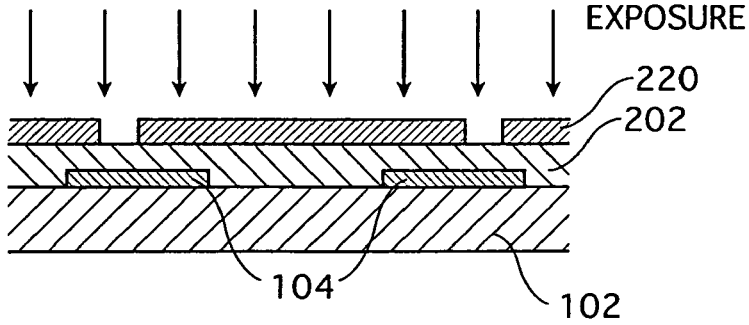

FIG. 5C illustrates how the silver electrode precursor layer 202 is exposed to light.

Figure 5D:
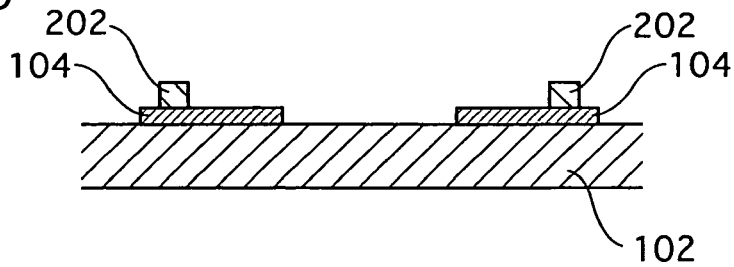

The supporting film 201 is removed, and the photomask 220 is superposed onto the silver electrode precursor layer 202. This photomask 220 has openings only at areas where the silver electrodes are to be formed. At times of light exposure, only those areas of the silver electrode precursor layer 202 where the silver electrodes are to be formed are exposed to light, and the photosensitive resin in the areas exposed to light gets hardened. Subsequently, when the silver electrode precursor layer 202 is developed, only the areas of the silver electrode precursor layer 202 that have been exposed to light remain, and thus are patterned in the shape of the silver electrodes 105. FIG. 5D shows the silver electrode precursor layer 202 that have been patterned.

Step 2: Forming a Dielectric Precursor

The electrode precursor layer that has been patterned in the process mentioned above will be covered by a dielectric precursor layer which is a precursor of the dielectric glass layer 106.

It is possible to, using the screen-printing method or the die coat method, form the dielectric precursor layer by applying and drying a dielectric paste that includes glass and an organic binder as requisite components, as well as a solvent.

Alternatively, like in Step 1, it is possible to form the dielectric precursor layer by pasting, using the lamination method, a dielectric sheet, which is in a form of film into which the requisite components of the dielectric paste are processed.

Step 3: Baking

The outcome of Step 2 will be left, for minutes to tens of minutes, at a temperature that is the same as or higher than the softening point of the glass components included in the electrode precursor layer and the dielectric precursor layer. Thus, the silver electrode precursor layer and the dielectric precursor layer get baked at the same time. The silver electrode precursor layer changes into silver electrodes 105, and the dielectric precursor layer changes into dielectric glass layer 106.

EFFECTS OF THE PRESENT EMBODIMENT

Figure 7:
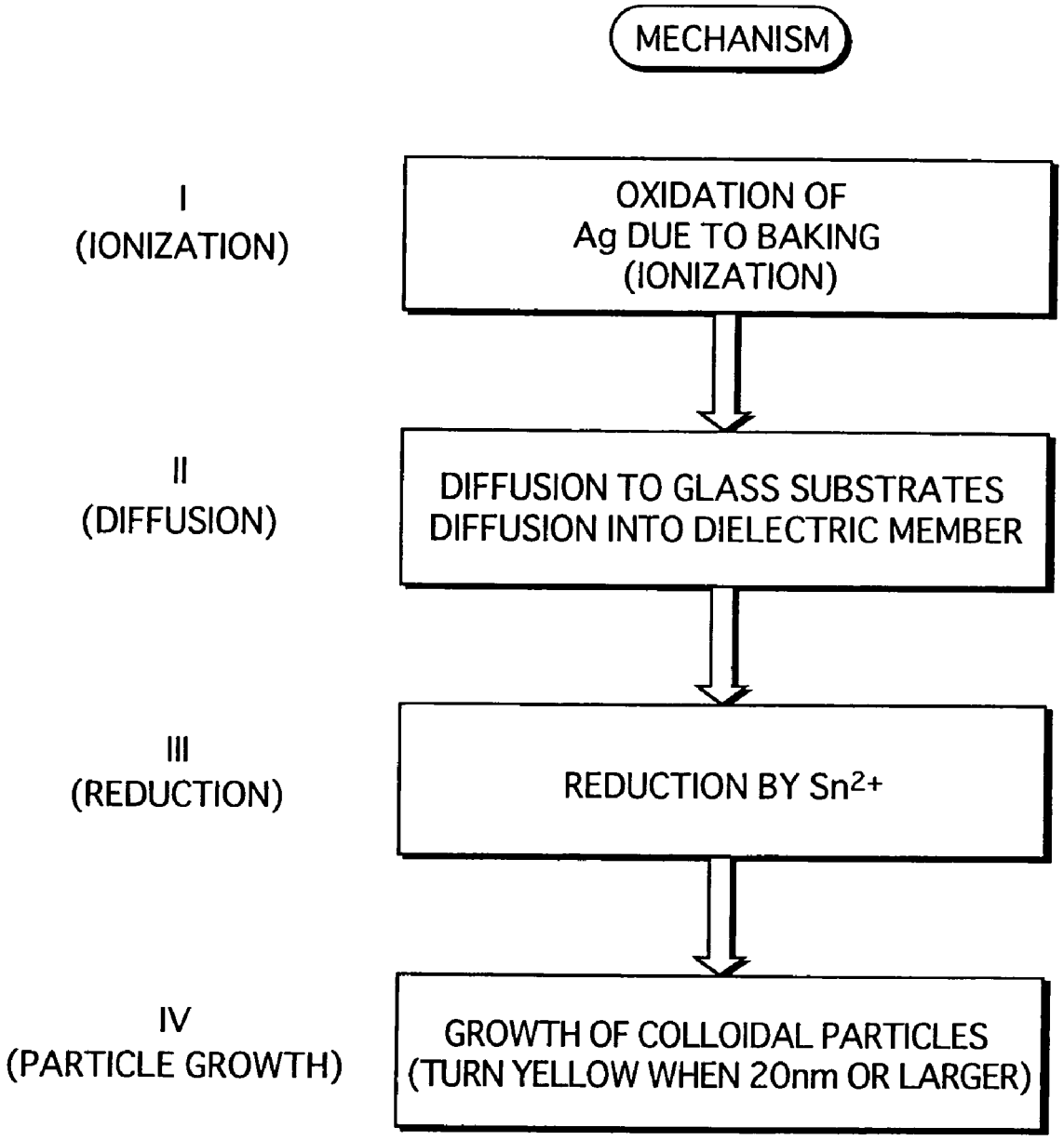
FIG. 7 describes the mechanism of yellowing of the glass substrates and the dielectric glass layer in a PDP of the prior art.

FIG. 7 describes the mechanism of the yellowing that occurs in the glass substrates and the dielectric glass layer of the PDP of the prior art.

As shown in the drawing, it is considered that the yellowing of the glass substrates occurs in stages as described below:

I. At the time when the silver electrodes are formed, the silver in the electrodes get ionized through oxidation or sulfuration while the silver electrodes are left in the atmosphere or while their temperature gets cooler after the baking.

II. Silver ions diffuse into the glass substrate surface and inside the dielectric glass layer.

III. The silver ions that have diffused get reduced by metal ions existing on the surface of the substrate glass and inside the dielectric glass layer. (The metal ions are the ones that have reducing action on silver ions; Sn ions mainly exist on the surface of the substrate glass, and Na ions and Pb ions exist inside the dielectric glass.)

IV. The reduced silver is then precipitated as silver colloidal particles, and the silver colloidal particles grow.

Since the silver colloidal particles have an absorption region at the wavelength of 400 nm, the substrate and the dielectric glass layer turn yellow.

As for the mechanism of the yellowing of glass by silver, "The Glass Handbook" (published by Asakura Shoten, Jul. 15, 1977) reads on Page 166 that when $Ag^+$ and $Sn^{2+}$ coexist in glass, a thermal reduction reaction proceeds as $2Ag^+ + Sn^{2+} \rightarrow 2Ag + Sn^{4+}$, and that the glass gets colored by silver colloids. Also, as for another related reference, there is J. E. Shelby and J. Vitko Jr., "Journal of Non-Crystalline Solids" Vol. 50 (1982) 107-117.

As mentioned above, generally speaking, while the silver electrode precursor layer is left in the atmosphere or while its temperature gets cooler after the baking, silver ions are generated; however, according to the method of the present embodiment, because the silver ionization inhibiting substance exists around the silver particles in the silver electrode precursor layer, the silver ionization inhibiting substance serves to inhibit generation of silver ions, and it is therefore possible to inhibit generation of silver ions while the layer is left in the atmosphere or while its temperature gets cooler after the baking (Stage I above). Thus, it is possible to prevent yellowing caused by flocculated colloids of silver.

Consequently, the PDP manufactured according to the method of the present embodiment has improved color temperature characteristics compared to a conventional PDP comprising silver electrodes.

It should be noted that the silver electrode precursor layer and the dielectric precursor layer do not need to be baked at the same time. Instead, it is acceptable to form a silver electrode precursor layer in Step 1 and bake it, before performing Step 2 in which the dielectric precursor layer is formed; however, the effects of inhibiting the yellowing are expected to be stronger when the silver electrode precursor layer and the dielectric precursor layer are baked at the same time, because silver ions are less likely to diffuse on the glass substrate when the silver electrode precursor layer is baked while being covered by the dielectric precursor layer.

Effects Achieved When the Silver Ionization Inhibiting Substance is Included in the Silver Electrodes As disclosed in the Japanese Unexamined Patent Application Publication No. 2000-169764 as a method of inhibiting the yellowing of a PDP comprising silver electrodes, it is possible to inhibit reduction of silver ions that have diffused from the silver electrodes to the substrates by adding cerium or the like to the dielectric glass layer.

It is considered that the effects of inhibiting the yellowing of the panel can be achieved even with such a method by which the reduction of silver ions is inhibited after the silver ions diffuse to the substrates; however, the effects of inhibiting the yellowing of the panel are even stronger with the method of the present embodiment by which a silver ionization inhibiting substance is included in the silver electrodes, because generation of silver ions itself is inhibited at the source where the silver ions are generated.

In addition, when cerium is added to the dielectric glass layer, since cerium itself changes the color of the dielectric glass layer into yellow, it gets more difficult to achieve a high color temperature at times of driving the PDP. On the contrary, in the present embodiment, the dielectric glass layer will not be colored by the silver ionization inhibiting substance, because the silver ionization inhibiting substance is not added to the dielectric glass layer. Thus, it is easier to achieve a high color temperature at times of driving the PDP.

Further, when a new component such as cerium is added to the dielectric glass, there might be some difficulties on a practical basis: When a dielectric glass layer has a crack or the like, the panel performance may be immediately degraded due to the reduced insulation pressure resistance. Thus, the glass composition used in a dielectric glass layer is normally adjusted so that the softening temperature and the thermal expansion ratio are appropriate for the baking temperature of the dielectric glass layer in order to have less possibilities of having cracks at times of baking. When cerium or the like is added to the glass to be used in a dielectric glass layer whose composition has already been adjusted, the softening temperature and the thermal expansion rate will be altered; it would be therefore necessary to adjust the glass composition again to correct the softening temperature and the thermal expansion rate.

On the contrary, the panel performance will not be immediately degraded by the silver electrodes, unlike the case of the dielectric glass layer. Accordingly, it is more practical to have an arrangement, as in the present embodiment, in which a silver ionization inhibiting substance is included in the silver electrodes.

SECOND EMBODIMENTS

Figure 6:
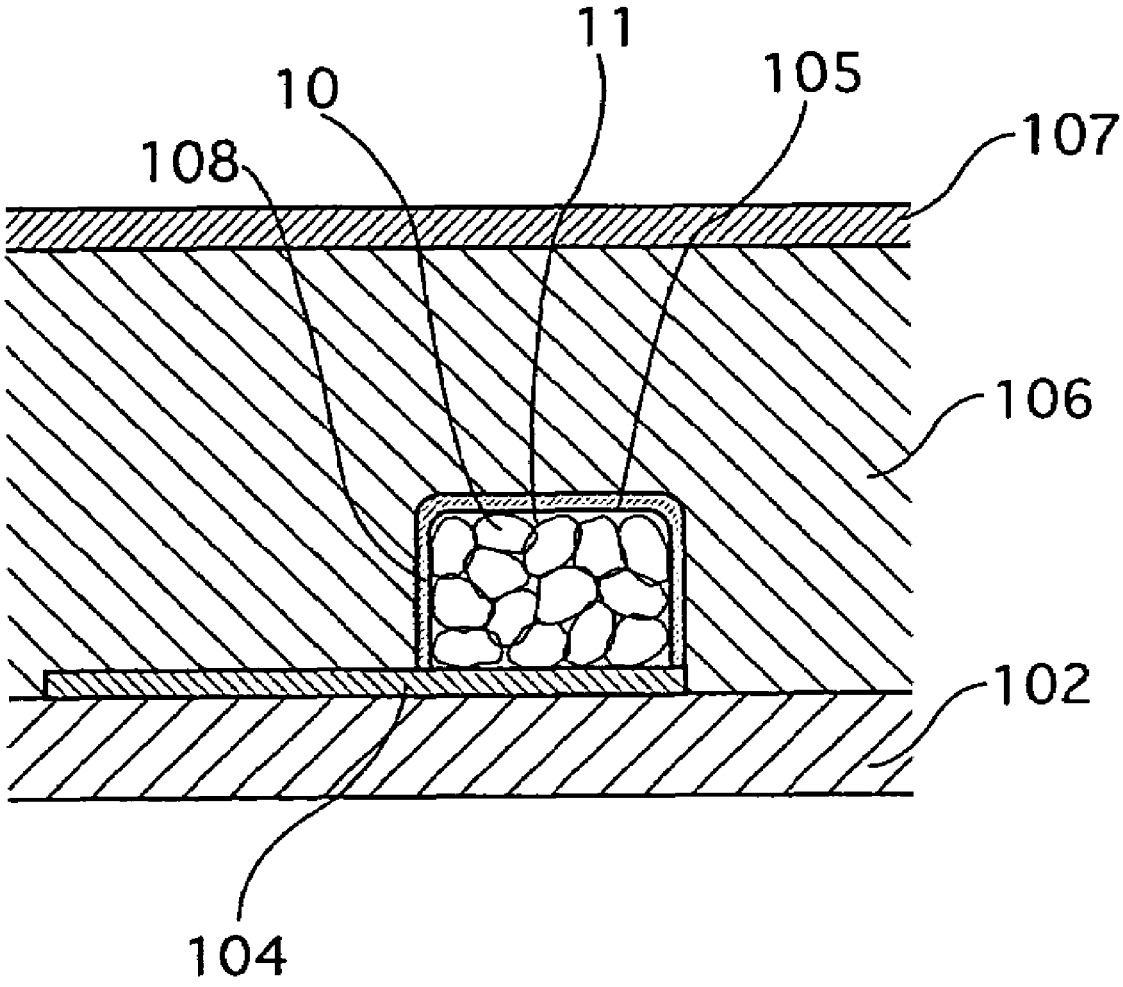
FIG. 6 is a cross section of the front panel of the second embodiment.

The PDP of the second embodiment has the similar structure to the PDP of the first embodiment, except that, in the second embodiment, a coating layer 108 made of a silver ionization inhibiting substance is formed on the surfaces of the silver electrodes 105, as shown in FIG. 6, whereas the silver ionization inhibiting substance exists in the silver electrodes 105 on the front panel 101 in the first embodiment.

As explained in the first embodiment, examples of a silver ionization inhibiting substance of which the coating layer 108 is made include: alkali metals (Li, Na, K, etc.); alkali-earth metals (Ca, Sr, Ba); Sc, Ti, V, Cr, Mn, Fe, Co, Ni, and Cu, which are transition metals (except for mercury and manganese) from which precious metals are excluded; an oxide, a hydroxide, a halide, a nitride, a carbide, a nitrate, a carbonate, and a sulfate of the elements above.

Preferred elements are Cr, Al, In, B, Ti, Ni, Pb, Zr, Sn, Zn, and Co. Preferred compounds are an oxide, a hydroxide, and a halide of the elements above. Nitrides such as TiN, ZnN, AlN, CrN, and BN as well as carbides such as TiC, SiC, and ZrC are also preferable compounds since each of them has a stronger chemical bond than an oxide of silver.

In the present embodiment, however, the silver ionization inhibiting substance is used as an ingredient to make the coating layer by which the surfaces of the electrodes are covered; it is therefore preferable to use a metal element or, as to compounds, an oxide, a nitride, or a carbide, in view of easiness in forming the layer.

In the PDP of the present embodiment, it is also possible to inhibit generation of silver ions on the silver electrodes 105 at the time of baking, like in the first embodiment, because of the silver ionization inhibiting substance included in the coating layer 108.

Regarding an area in which the coating layer 108 is to be formed, it is preferable to form the coating layer 108 only on the surfaces of the silver electrodes 105 in order to ensure visible light transmittance of the front panel 101; however, when a non-conductive material with high transparency is used as a silver ionization inhibiting substance, it is possible to ensure visible light transmittance of the front panel 101 even if the coating layer 108 is formed on all over the surface of the glass substrate 102.

In order to sufficiently achieve the effects of inhibiting silver ionization, it is preferable to arrange the thickness of the coating layer 108 to be 0.01 μm or more. When the coating layer 108 is thicker, it would take more time and cost more to form the coating layer 108, besides there may be a possibility of causing a dielectric breakdown in the dielectric glass layer; therefore, it is preferable to arrange the thickness to be 1 μm or less.

Manufacturing Method of the Front Panel

The manufacturing method of the front panel 101 of the second embodiment is similar to the manufacturing method of the front panel 101 of the first embodiment, except that there are differences in the process of forming the silver electrodes and the dielectric glass layer.

The following describes the process of forming the silver electrodes and the dielectric glass layer.

Step 1: Forming a Silver Electrode Precursor Layer

This step is performed in the similar manner as Step 1 of the first embodiment, except that a silver ionization inhibiting substance does not get mixed in when the silver-electrode-purpose paste is prepared.

Step 2: Baking the Electrode Precursor Layer

The outcome of Step 1 will be left, for minutes to tens of minutes, at a temperature that is the same as or higher than the softening point of the glass components included in the silver electrode precursor, and then will cool down. Through this baking, the silver electrode precursor layer changes into the silver electrodes 105.

Step 3: Coating Electrodes

A coating layer that is made of the aforementioned silver ionization inhibiting substance is formed so as to cover the silver electrodes 105 that have been formed.

Examples of methods that can be used in forming such a coating layer includes: the vacuum evaporation method, the sputtering method, the plating method (the electroplating method, or the electroless plating method), the sol-gel method, the ion plating method, and the CVD method.

Here, when the coating layer is to be formed only on the surfaces of the silver electrodes 105, the coating process can be performed using a covering mask that has openings at areas where the silver electrodes 105 are positioned.

The vacuum evaporation method is generally suitable for forming a coating layer made of a metal element or an alloy. For example, it is possible to form a coating layer made of Al, Ni, Cr, Pb, Sn, Zr, B, or Ni—Cr alloy. It is also possible to form a coating layer made of an oxide, such as $Al_2O_3$, $In_2O_3$, or $SiO_2$.

Using the sputtering method, it is possible to form a same kind of coating layer as when the vacuum evaporation method is used.

The plating method is suitable for forming a coating layer made of a metal element, for example, made of Al, Ni, Cr, Pb, Sn, or Zr.

The sol-gel method is suitable for forming a coating layer made of an oxide, e.g. $ZrO_2$, $SiO_2$, $TiO_2$, $AlO_2$, $B_2O_2$, or $P_2O_2$.

The ion plating method and the CVD method are suitable for forming a coating layer made of an oxide, a nitride, or a carbide. Using the ion plating method, it is possible to form a coating layer made of $TiO_2$, $ZnO_2$, $AlO_2$, $CrO_2$, TiN, ZnN, AlN, or CrN, for instance. Using the CVD method, it is possible to form a coating layer made of $B_2O_3$, BN, or $P_3N_5$, in addition to a coating layer made of an oxide or a nitride mentioned above.

It should be noted that when a coating layer is formed using the evaporation method or the sputtering method, the layer is formed mainly on the top surfaces of the electrodes, and the layer is less likely to be formed on the side surfaces of the electrodes. When a coating layer is formed using the electroplating method, however, it is possible to form the coating layer not only on the top surfaces of the silver electrodes, but also on the side surfaces of them.

In the latter case, since the surfaces of the electrodes are covered all over by the silver ionization inhibiting substance, it is considered that the effects of inhibiting silver ionization are stronger.

Step 4: Forming a Dielectric Precursor Layer

A dielectric precursor layer is formed so as to cover the silver electrodes that have been covered with the coating layer. This step is the same as Step 2 of the first embodiment.

Step 5: Baking

This step is the same as Step 3 of the first embodiment, and the outcome of Step 4 will be baked at a temperature that is the same as or higher than the softening point of the glass components included in the dielectric precursor layer.

According to the manufacturing method of the present embodiment as so far explained, when Step 5 (baking process) is performed, the silver electrodes are covered by the coating layer, and the silver ionization inhibiting substance included in the coating layer serves to inhibit generation of silver ions. Consequently, it is possible to inhibit generation of silver ions in the baking process.

In addition, since the silver electrodes are covered by the coating layer, it is possible to prevent the generated silver ions from diffusing.

Consequently, it is possible to prevent the panel from turning to yellow, which may be caused by flocculated colloids of silver; therefore, the PDP manufactured according to the aforementioned manufacturing method has improved color temperature characteristics compared to a conventional PDP comprising silver electrodes.

EXAMPLES OF EMBODIMENT

TABLE 1

| Sampling Number | Additive/ Covering Material | Additive Amount | Panel after baking the dielectric member Value a* | Value b* | Panel Color Temperature |
|---|---|---|---|---|---|
| 1 | Cr | 5% | −1.2 | 0.8 | 9300 |
| 2 | Al | 5% | −1.8 | 1.5 | 9050 |
| 3 | In | 5% | −1.5 | 1.9 | 8930 |
| 4 | B | 5% | −2.5 | 2.0 | 8900 |
| 5 | Ti | 5% | −2.2 | 1.3 | 9080 |
| 6 | Cover with Cr | — | −1.5 | 0.4 | 9500 |
| 7 | Cover with Al | — | −1.8 | 0.9 | 9350 |
| 8 | Cover with $Al_2O_3$ | — | −1.3 | 0.8 | 9320 |
| 9 | Cover with $TiO_2$ | — | −1.5 | 1.2 | 9040 |
| 10 | Cover with $SiO_2$ | — | −1.4 | 1.1 | 9120 |
| *11 | None | None | −11.2 | 10.9 | 6400 |

Sampling No. 11 is a comparison example

In Table 1, the PDPs shown with the sampling numbers No. 1 through No. 5 each comprise silver electrodes that include Cr, Al, In, B, or Ti respectively as a silver ionization inhibiting substance according to the first embodiment. Those silver electrodes are made using different silver pastes to which each silver ionization inhibiting substance is added by 5 wt % of the silver particles.

The PDPs shown with the sampling numbers No. 6 through No. 10 each comprise silver electrodes on the surfaces of which, according to the second embodiment, a coating layer made of a silver ionization inhibiting substance (Cr, Al, $Al_2O_3$, $TiO_2$, or $SiO_2$) is formed using the vacuum evaporation method, within a range of thickness of 0.3 to 0.5 μm.

The PDP shown with the sampling number No. 11 is a comparison sample, and no silver ionization inhibiting substance is included in the silver electrodes, and no coating layer is formed.

The specifications mentioned below are common to all the PDPs of No. 1 through No. 11:

The glass substrates are "PD200" made by Asahi Glass Co., Ltd. using the float method.

The dielectric glass layer is made with a dielectric glass paste whose main component is PbO—$B_2O_3$—$SiO_2$—CaO-system glass, using the printing method so as to be approximately 30 μm in thickness. The MgO protective layer is made using the sputtering method.

The cell size of PDP is arranged for a 42-inch VGA display, so that the height of the barrier ribs 115 is 0.15 mm, the interval (the cell pitch) between the barrier ribs 115 is 0.36 mm, and the inter-electrode distance "d" between the display electrodes 103 is 0.10 mm.

Measuring the Yellowness of the Panels and the Color Temperature

At the time of manufacturing the PDPs of No. 1 through No. 11, for each of the front panels, the "a*" value and the "b*" value (JIS Z8730 color difference specification method) were measured using a color-difference meter (Item No. NF777 manufactured by Nippon Denshoku Industries Co., Ltd.).

The "a*" value and "b*" value are indicators of the coloring degree and the coloring tendency of the panels.

The larger the "a*" value is in the positive direction, the stronger the red coloring is. The larger the "a*" value is in the negative direction, the stronger the green coloring is. On the other hand, the larger the "b*" value is in the positive direction, the stronger the yellow coloring is. The larger the "b*" value is in the negative direction, the stronger the blue coloring is. When the "a*" value is in a range of −5 to +5, and the "b*" value is in a range of −5 to +5, the coloring of the glass substrate (yellowing) is hardly visible with the naked eye. When the "b*" value exceeds 10, however, the yellowing is distinctively visible even with the naked eye.

Also, for the PDPs of No. 1 through No. 11, the color temperature at the time of displaying the full-white image was measured using a multichannel spectrometer (MCPD-7000 manufactured by Otsuka Electronics Co., Ltd.).

The results are shown in Table 1.

Observation

From the results, it is understood that the PDP of No. 11, which is a comparison example, has the "b*" value of more than 10 and is presented with notable yellowing, whereas the PDPs of No. 1 through No. 10 according to the embodiments of the present invention each have the "b*" value in a range of 0.4 to 2.0 and is presented with hardly any yellowing.

In the PDP of the comparison example, the color temperature is as low as 6400K, whereas in the PDPs of the embodiments, the color temperature is as high as 8900K or higher.

These results indicate that the PDPs of the embodiments of the present invention exhibit better color reproduction and thereby enable more vivid display than the PDP of the comparison example.

In addition, similar results were achieved even when dielectric glass of $Bi_2O_3$-system or ZnO-system is used as an ingredient of the dielectric glass layer, instead of the one of PbO-system.

Further, the results above substantiate the notion that the elements such as Cr, Al, In, Si, Ti, and B as well as the oxides thereof are superior as a silver ionization inhibiting substance.

MODIFICATION EXAMPLES

In the embodiments above, illustrated are examples in which the present invention is applied to the display electrodes in consideration of the large influence that the yellowing of the front panel gives to the display quality of the PDP; however, it is also possible to inhibit yellowing of the rear panel when the present invention is applied to the address electrodes on the rear panel.

In addition, in the embodiments above, the examples described are AC surface-discharge-type PDPs in which silver electrodes are covered by a dielectric glass layer; however, it is possible to achieve the same effects of inhibiting the yellowing of the glass substrates when the present invention is applied to a DC-type PDP in which silver electrodes are formed on the glass substrates so as to be exposed to the discharge space.

INDUSTRIAL APPLICABILITY

The PDP and the PDP display device of the present invention are effective in use for display devices for computers and televisions, and particularly for large-scale display devices.

The invention claimed is:

1. A plasma display panel in which a pair of substrates are disposed opposing each other with a space therebetween, and a silver electrode including silver particles bonded to one another is disposed on at least one of the pair of substrates, wherein the silver electrode further comprises, in spaces between or in vicinity of surfaces of the silver particles, at least one element selected from the group consisting of In and B and exclusive of any compound of In and B.

2. The plasma display panel of claim 1, wherein the element added to the silver particles covers the silver particles to inhibit silver ionization.

3. The plasma display panel of claim 2 wherein diameter of the silver particles are approximately 1 μm to 3 μm and a ratio of the inhibiting element to the silver is approximately 0.5% wt to 10% wt.

4. The plasma display panel of claim 3 wherein a diameter of the inhibiting element is 1 μm or smaller.

5. A plasma display panel as claimed in claim 1 wherein diameters of the silver particles are approximately in the range of 1 μm to 3 μm and the element in spaces between or in the vicinity of surfaces of the silver particles, are 1 μm or smaller.

6. A paste to be used for forming silver electrodes of a plasma display panel, the paste consisting of:

silver; and at least one element added as a mixture with the silver, said at least one element being Si and exclusive of any compound of Si wherein the paste is configured in the form of an elongated silver electrode to extend across the plasma display panel, wherein the silver consists of particles and the one element covers the silver particles by a sufficient amount to inhibit silver ionization that causes a discoloring of the plasma display panel.

7. A plasma display panel in which a pair of substrates are disposed opposing each other with a space therebetween, and a silver electrode including silver is disposed on at least one of the pair of substrates, wherein the silver electrode includes a compound selected from the group consisting of AlN, BN, and SiC.

8. A paste to be used for forming silver electrodes of a plasma display panel, the paste comprising:

silver; and a compound selected from the group consisting of hydroxides of In, B, Ti, Pb, Zr, Sn, and Zn, and halides of Cr, In, B, Ti, Ni, Pb, Zr, and Co, wherein the paste is configured in the form of an elongated silver electrode to extend across the plasma display panel, wherein the silver consists of particles and the compound is approximately 0.5% wt to 10% wt and covers the silver particles to inhibit silver ionization that causes a discoloring of the plasma display panel.

9. A transfer film to be used for forming silver electrodes of a plasma display panel, the transfer film including a silver electrode film material layer that is disposed on a supporting film, wherein the silver electrode film material layer comprises:

silver particles; and a compound selected from the group consisting of hydroxides of Al, In, B, Ti, Pb, Zr, Sn, Zn, and Co, and halides of Cr, Al, In, B, Ti, Ni, Pb, Zr, Sn, Zn, and Co as a silver ionization inhibiting substance mixed into spaces adjacent the silver particles.

10. A transfer film as claimed in claim 9 wherein ionization diameters of the silver particles are approximately in the range of 1 μm to 3 μm and the silver inhibiting substance element in spaces between or in the vicinity of surfaces of the silver particles, are 1 μm or smaller.

11. A transfer film to be used for forming silver electrodes of a plasma display panel, the transfer film including a silver electrode film material layer that is disposed on a supporting film, wherein the silver electrode film material layer comprises:

silver particles; and a compound selected from the group consisting of AlN, BN, and SiC as a silver ionization inhibiting substance mixed into spaces adjacent the silver particles.

12. A transfer film as claimed in claim 11 wherein diameters of the silver particles are approximately in the range of 1 μm to 3 μm and the silver ionization inhibiting substances in spaces between or in the vicinity of surfaces of the silver particles, are 1 μm or smaller.

13. A paste to be used for forming silver electrodes of a plasma display panel, the paste comprising:

silver configured in the form of an elongated silver electrode to extend across the plasma display panel, wherein the silver consists of particles; and ZrC is approximately 0.5% wt to 10% wt and covers the silver particles to inhibit silver ionization that causes a discoloring of the plasma display panel.

14. A plasma display panel in which a pair of substrates are disposed opposing each other with a space therebetween, and a thick film silver electrode of the type formed by using one of a screen-printing method and a die cast method including silver particles bonded to one another is disposed on at least one of the pair of substrates, wherein the silver electrode comprises a mixture of the bonded silver particles and a silver ionization inhibiting substance mixed into spaces adjacent the silver particles in such a manner to inhibit ionization of the silver particles, the silver ionization inhibiting substance includes $P_2O_3$.

15. A plasma display panel in which a pair of substrates are disposed opposing each other with a space therebetween, and a thick film silver electrode of the type formed by using one of a screen-printing method and a die cast method including silver particles bonded to one another is disposed on at least one of the pair of substrates, wherein the silver electrode comprises a mixture of the bonded silver particles and a silver ionization inhibiting substance mixed into spaces adjacent the silver particles in such a manner to inhibit ionization of the silver particles, the silver ionization inhibiting substance includes a compound selected from the group consisting of AlN, BN, and SiC.

* * * * *